United States Patent [19]

Smith

[11] Patent Number: 4,687,198

[45] Date of Patent: Aug. 18, 1987

[54] RECREATIONAL PLATFORM

[76] Inventor: Terry W. Smith, 3618 NE. 167 St., N. Miami Beach, Fla. 33160

[21] Appl. No.: 816,433

[22] Filed: Jan. 6, 1986

[51] Int. Cl.[4] ..... A63B 23/04

[52] U.S. Cl. ..... 272/114; 272/146

[58] Field of Search ..... 272/1 R, 33 R, 33 A, 272/94, 96, 146, 97, 114, 146; 188/82.2, 82.3, 82.34, 82.4, 82.7, 82.77, 69; D21/66, 193

[56] References Cited

U.S. PATENT DOCUMENTS

| | | | |
|---|---|---|---|
| 2,878,858 | 3/1959 | Winchester | 272/33 A |
| 3,024,021 | 3/1962 | Coplin et al. | 272/146 |
| 3,068,963 | 12/1962 | Smith et al. | 188/69 |
| 3,188,087 | 6/1965 | Larson, Jr. | 272/1 R X |
| 3,262,701 | 7/1966 | Howland . | |
| 3,306,626 | 2/1967 | Kawada | 272/146 |
| 3,384,369 | 5/1968 | Rumell | 272/33 R X |
| 3,512,774 | 5/1970 | Homer | 272/146 |
| 3,604,726 | 9/1971 | Tracy . | |
| 3,612,520 | 10/1971 | Chang et al. | 272/146 X |
| 3,749,399 | 7/1973 | Fedor et al. | 272/33 A |
| 3,761,084 | 9/1973 | Dieckmann | 272/146 |
| 3,784,193 | 1/1974 | Simjian | 272/146 X |
| 4,084,273 | 4/1978 | Haynes . | |
| 4,193,592 | 3/1980 | Bishow | 272/114 |
| 4,222,473 | 9/1980 | Kopich | 188/82.7 X |
| 4,576,372 | 3/1986 | Rinaldi | 272/146 |
| 4,605,224 | 8/1986 | Torii | 272/33 A X |

FOREIGN PATENT DOCUMENTS

| | | | |
|---|---|---|---|
| 265940 | 9/1965 | Australia | 272/33 A |
| 2224216 | 10/1973 | Fed. Rep. of Germany | 172/146 |
| 530199 | 7/1955 | Italy | 272/33 R |

*Primary Examiner*—Richard J. Johnson

*Attorney, Agent, or Firm*—Luke J. Wilburn, Jr.

[57] ABSTRACT

A recreational device with the shape of a dish or plate that can be manipulated to rotate and track over a bearing surface requiring considerable skill from the user. The dish device includes a platform that is rotatably mounted over a contact plate and a locking mechanism that allows the user to lock the rotation or allow, selectively, to rotate in one direction or the other. The platform in the preferred embodiment has substantially the same diameter as the plate member. In one of the alternate embodiments, however, the platform member has a smaller diameter and a static platform member is added to provide the user with an area that is rigidly mounted to the contact plate member.

9 Claims, 10 Drawing Figures

RECREATIONAL PLATFORM

BACKGROUND OF THE INVENTION

1. Field of the Invention

The present invention relates to recreational devices, and more particularly to such devices that help develop physical skills in balance, manipulation and coordination.

2. Description of the Prior Art

General platform recreational devices have been invented or used in the past, providing different mechanisms, structures and movements. Applicant believes that the closest reference corresponds to U.S. Pat. No. 3,262,701, issued to E. Howland. However, it differs from the present invention because it is a unitary structure without the rotatable platform or the spherical contact plate found in the present invention. Another patent in the field corresponds to U.S. Pat. No. 3,604,726 issued to C. W. Tracy. Here, a freely rotatable ball is mounted to a platform with ball bearings. Even though there is contact with a spherical component, the user will not be able to track or traverse over the bearing surface. Also, the small radius of curvature in Tracy's device limits the possible manipulations since the user's center of gravity has to be vertically projected to a point within the spherical contact area.

Other patents describing the closest subject matter provide for a number of more or less complicated features that fail to solve the problem in an efficient and economical way. None of these patents suggest the novel features of the present invention.

SUMMARY OF THE INVENTION

It is the main object of the present invention to provide a recreational device that is safe, sturdy and easy to use while it helps the user to enjoyably develop skills and create unique movements.

It is another object of the present invention to provide such a device that is relatively inexpensive to manufacture and maintain while retaining its effectiveness.

It is yet another object of the present invention to provide a device that has a low profile and no protrusions that would damage the user or surroundings.

It is still another object of this invention to provide a device that can be safely utilized indoors.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED AND ALTERNATE EMBODIMENTS OF THE PRESENT INVENTION

Figure 1:
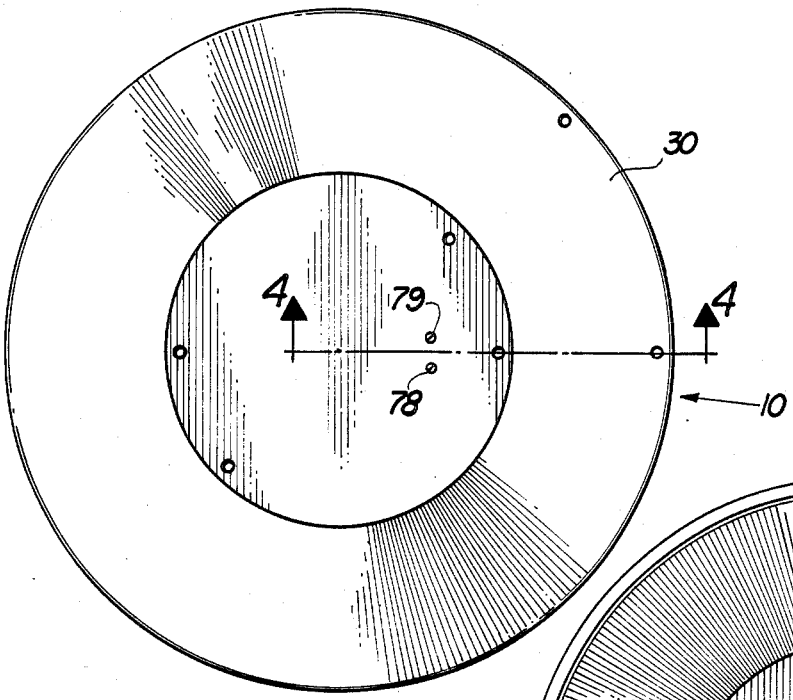
FIG. 1 is a top view of the preferred embodiment of the present invention.
Figure 3:
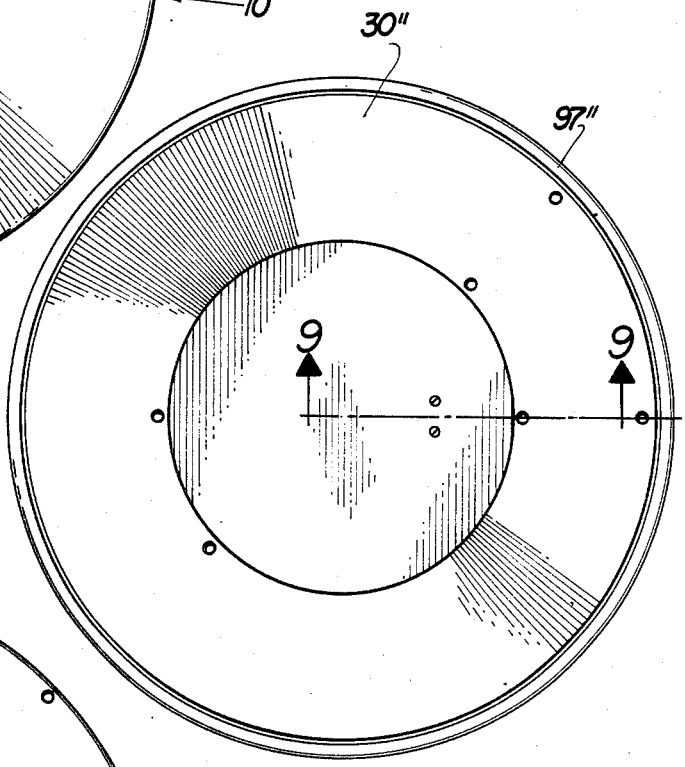
FIG. 3 represents a top view of the second alternate embodiment for the present invention.
Figure 2:
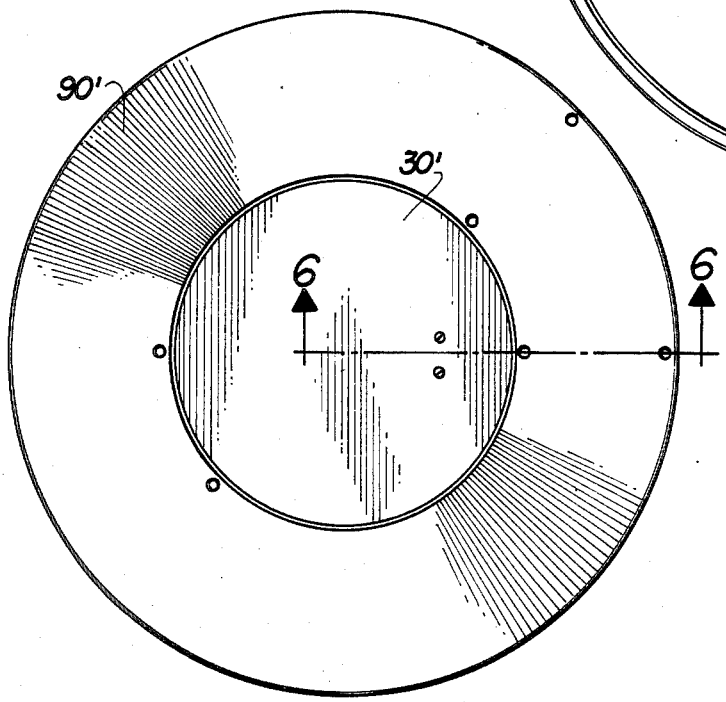
FIG. 2 represents a top view of the first alternate embodiment for the present invention.
Figure 4:
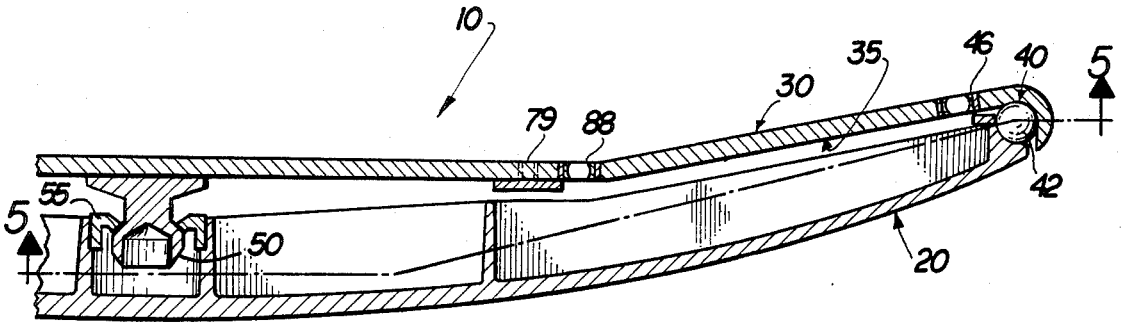
FIG. 4 shows a cross-sectional view taken along line 4—4 in FIGS. 1 and 5.
Figure 5:
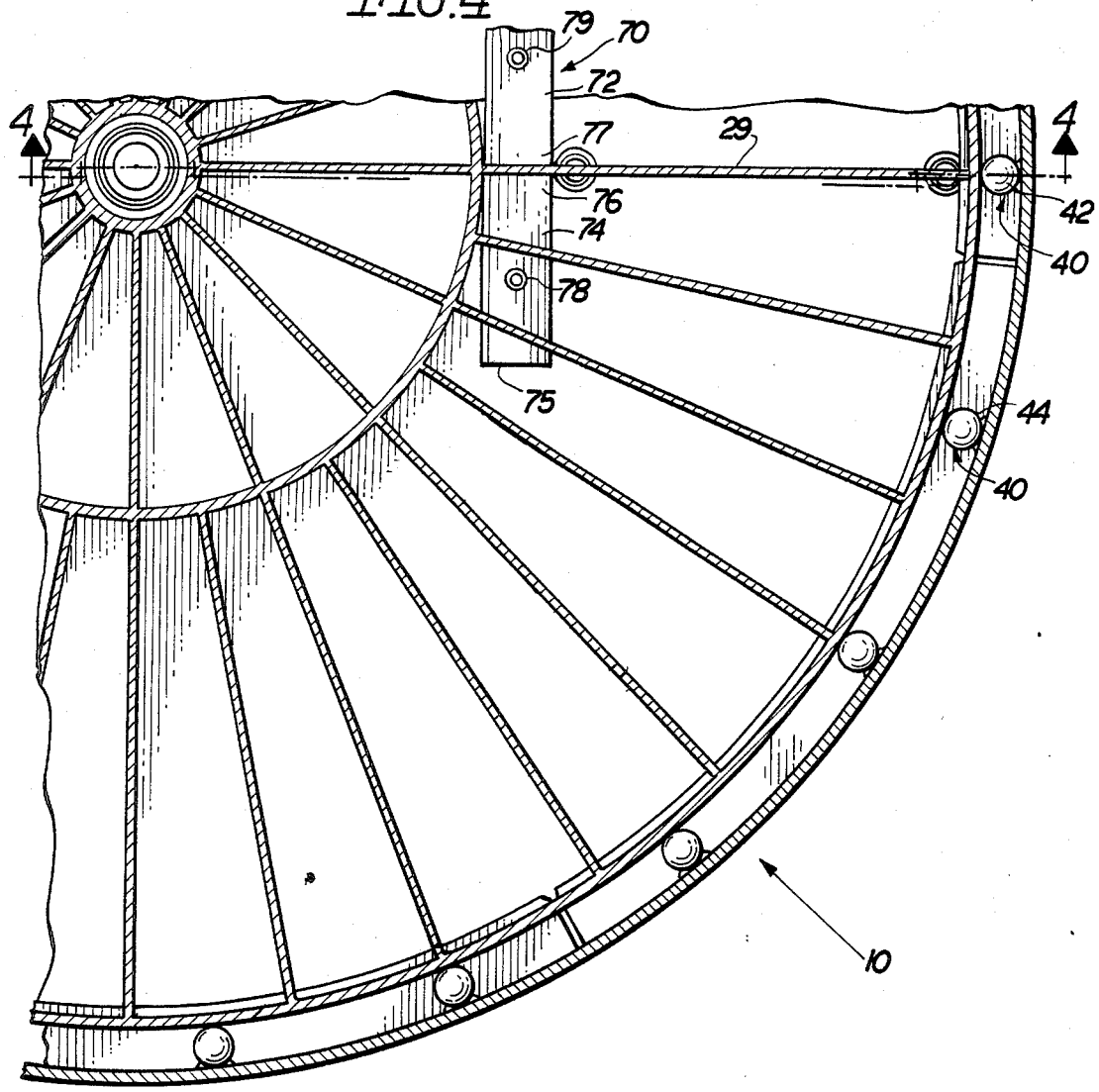
FIG. 5 represents a view of a portion of the preferred embodiment as seen from line 5—5 in FIG. 4.
Figure 9:
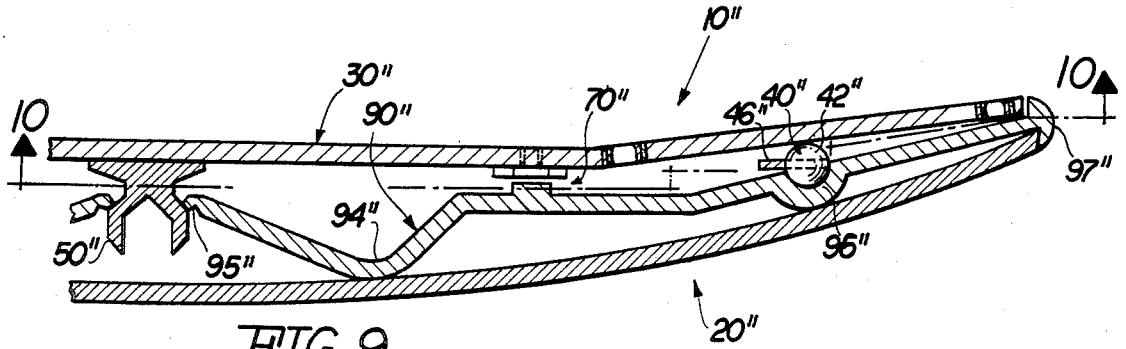
FIG. 9 is a cross-sectional view taken along line 9—9 in FIG. 3.
Figure 10:
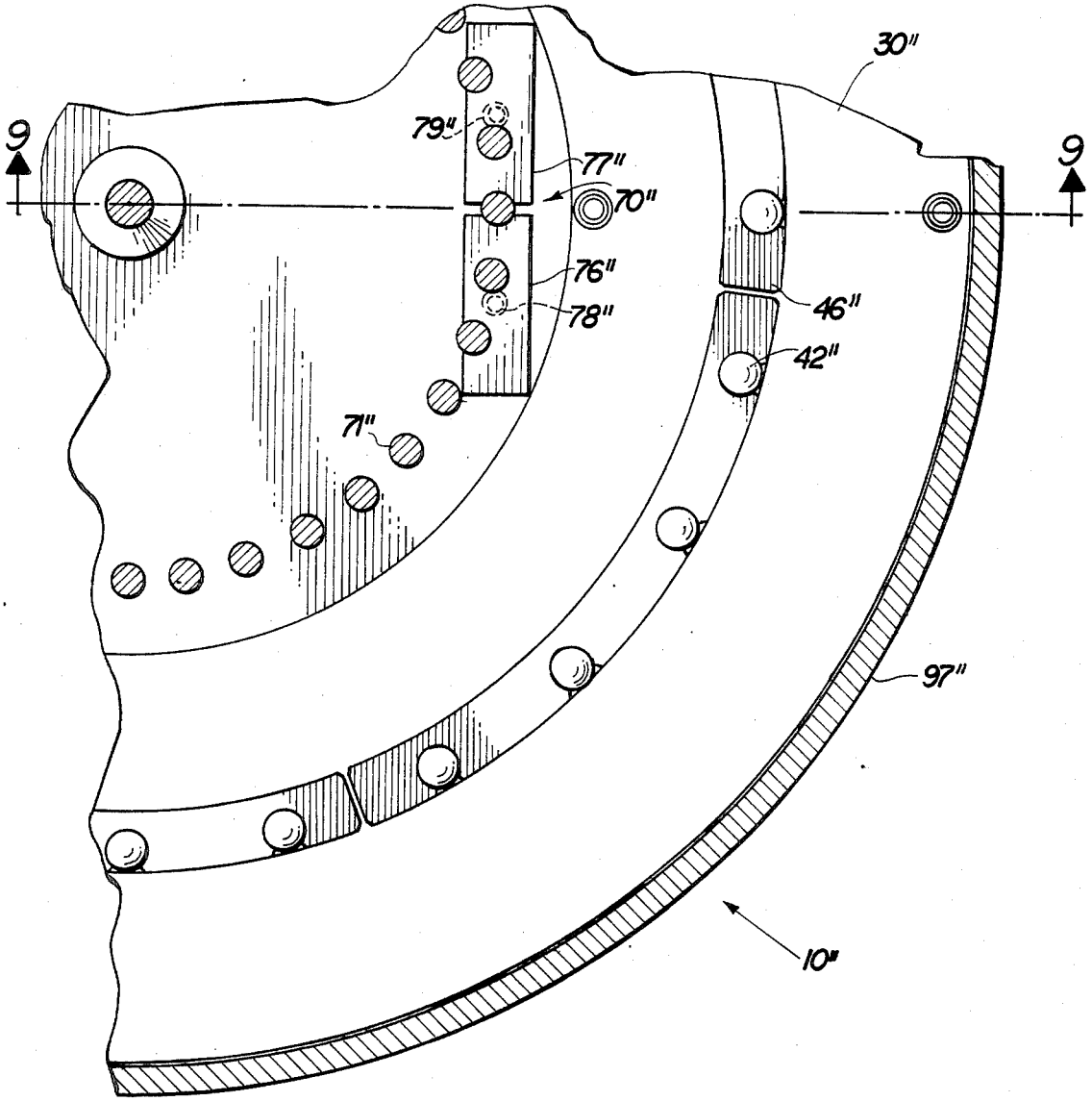
FIG. 10 is a view of a portion of the second alternate embodiment for this invention with a broken section as seen from line 10—10 in FIG. 9.

Three different embodiments will be described below. The preferred embodiment is represented in FIGS. 1, 4 and 5, and it corresponds to a device suitable for injection molded plastic processes. The first alternate embodiment corresponds to a design compatible with vacuum molded plastic manufacturing processes, as shown in FIGS. 2; 6; 7 and 8. The second alternate embodiment is designed for rotary molded plastic manufacturing processes and it is illustrated in FIGS. 3, 9 and 10.

Referring now to FIGS. 1; 4 and 5, the preferred embodiment of the present invention is referred to generally with the numeral 10. Basically, device 10 includes a contact plate member 20 and a rotatable platform member 30 supportably mounted thereon. Contact plate member 20 has a slight spherical curvature or arc that lifts its outer edge off the surface when resting on it. Contact plate member 20 may also have an annular shape, like a life saver, but there is still only one contact bearing point. Antifriction devices, such as ball bearing assemblies 40, and connecting devices, such as hub 50 and hub socket 55, keep contact plate member 20 and rotatable platform 30 attached to each other. Rotatable platform 30 has a slight concave conical shape from the peripheral edge and becomes flat on its central area, in the preferred embodiment. The top surface of rotatable platform 30 is firm, smooth or frictionally textured. Contact plate member 20 is compounded and skinned with material of varying frictional indices and durability depending on intended usage. For instance, if the supporting floor is carpeting then the user may want to use a material for member 20 that has a lower frictional index than if the use would be on tile.

Ball bearing assemblies 40 include balls 42 trapped withing cages 44 formed by cage ring member 46 which is illustrated in FIGS. 4 and 5. Member 46 may or may not be interrupted at intervals or sectors but their important function is to keep balls 42 in place.

The user has four options: platform member 30 may be rigidly held in place with respect to contact plate member 20; or plate member 20 may be allowed to rotate in one direction, or in the other direction; or in both directions freely. This is accomplished by using locking mechanism assembly 70. Locking mechanism assembly 70 comprises, as shown in FIG. 5 in the preferred embodiment, locking latches 72 and 74 that are aligned with each other and rigidly mounted on their outer ends to the lower surface 35 of rotatable platform member 30. Only outer end 75 is shown in FIG. 5 since the other one is cut off from the picture. Set screws 78 and 79 are used to deflect free ends 76 and 77 downwardly to lock platform 30 in both or either direction. The locking function is accomplished by engaging free ends 76 and/or 77 with radially extending rib element 29. Instead of ribs 29, any other perpendicularly mounted protrusions may be used to cooperate with free ends 76 and 77 in order to lock platform 30 in place with respect to contact member plate 20. However, ribs 29 also provide structural integrity to plate member 20. Ball sockets 88 are provided for easily attaching handles or bridle members (not shown) to facilitate the handling and use, respectively, of the present invention.

Figure 6:
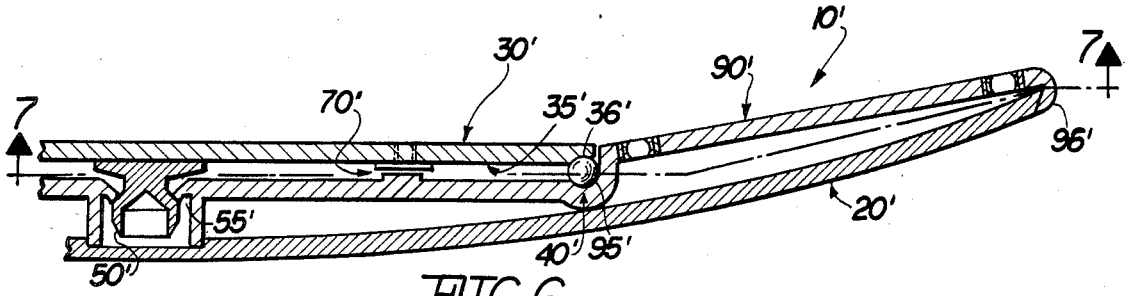
FIG. 6 is a representation of a cross-sectional view taken along line 6—6 in FIG. 2.
Figure 7:
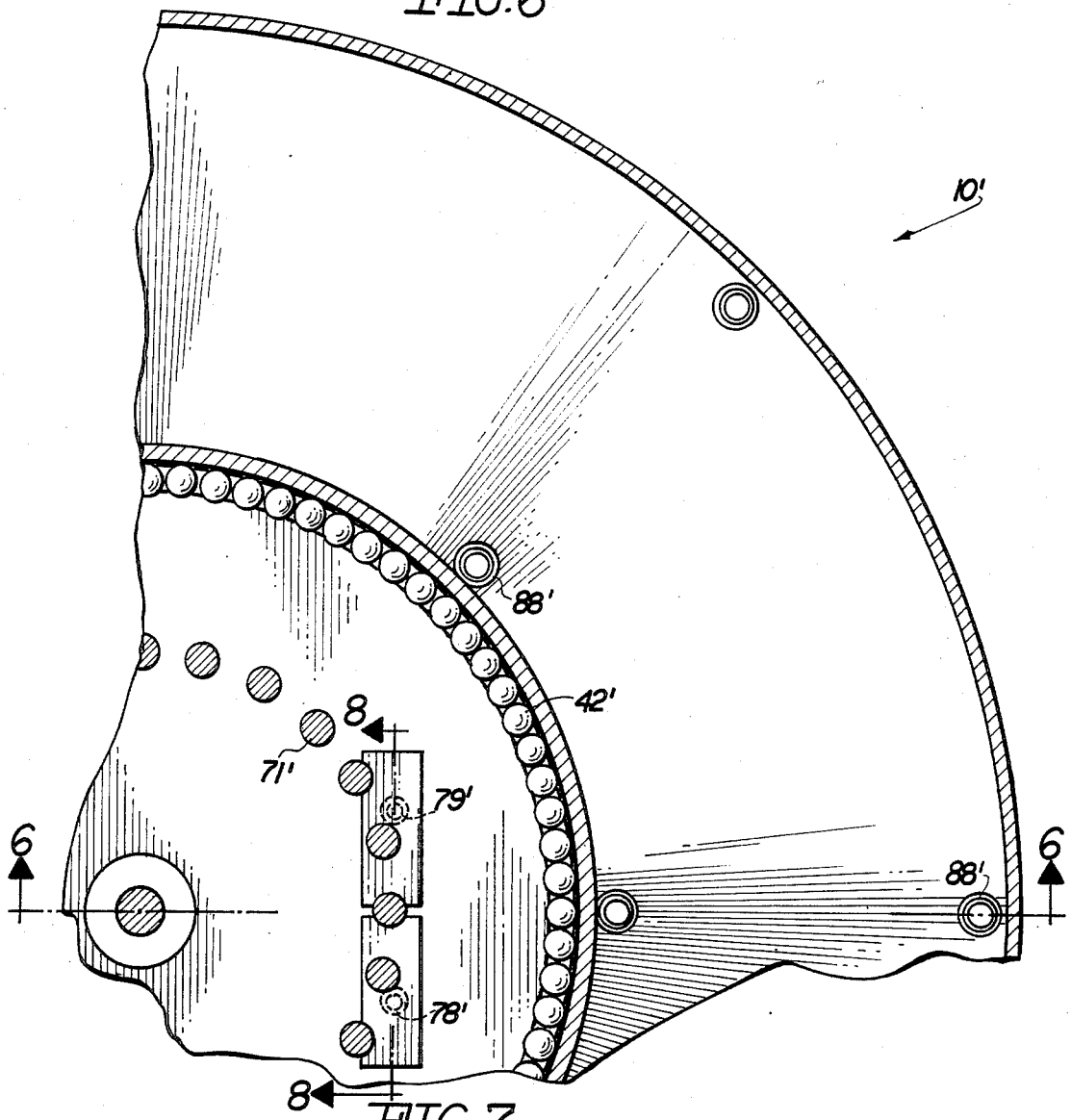
FIG. 7 illustrates a view of a portion of an alternate embodiment of the present invention as seen from line 7—7 in FIG. 6.

The first alternate embodiment 10′ is shown in FIGS. 2; 6; 7 and 8 and its elements are identified with primed numerals that correspond to their counter part, whenever there is one, in the preferred embodiment described above. Referring to FIG. 6, it can be seen that rotatable platform member 30′ is similarly rotatably mounted to and held in place with respect to contact plate member 20′. However, there is an additional static platform member 90′. Platform member 30′ has a relatively smaller diameter than platform member 30. In fact, only the central part of member 30 corresponds to platform member 30′. Static platform member 90′ forms hub socket 55′ that houses hub 50′ which is rigidly mounted to underside 35′ of member 30′. Peripheral groove 95′ partially forms ball bearing assembly 40′ and is complemented with a concave portion 36′ formed on the underside of platform 30′. Static platform member 90′ terminates on its outer end with shoulder 96′ that engages with the outer termination of contact plate 20′.

Figure 8:
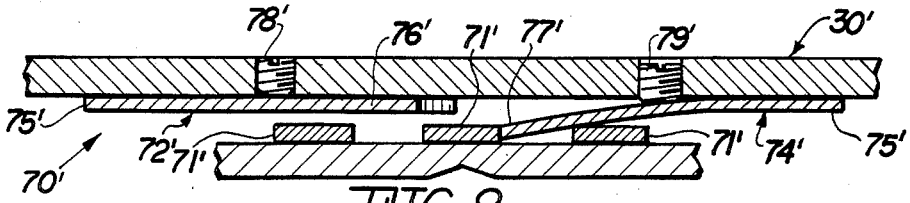
FIG. 8 shows a detailed view of the locking mechanism of the alternate embodiment shown in FIGS. 6 and 7.

Locking mechanism 70′ includes, as seen in FIG. 8, locking latches 72′ and 74′ mounted, on their outer ends 75′, to underside surface 35′. Set screws 78′ and 79′ deflect free ends 76′ and 77′ downwardly to lock platform 30′ in both or either direction. The locking function is accomplished by engaging free ends 76′ and 77′ with posts 71′. As shown in FIG. 8, latch member 77′ engages the middle post and prevents platform member 30′ from moving to the left. Platform 30′ moves freely to the right.

Ball sockets 88′ are provided for easily attachment of carrying handles (not shown) that facilitate the transportation of the invention.

Referring now to FIGS. 3, 9 and 10, where the second alternate embodiment is represented, it can be seen that it also comprises of analogous elements in a somewhat different combination and the elements have been marked with a double prime notations. Contact plate member 20″ is similar to its counterparts 20 and 20′. Rotatable platform member 30″ is similarly mounted on member 20″ through hub member 50″ and a socket is formed by the inner peripheral termination 95″ of static plate member 90″. Termination 95″ traps hub member 50″ and each portion 94″ provides a resting point on the inner surface of contact plate member 20″ along with the resting point provided by peripheral groove 96″.

Ball bearing assembly 40″ includes ball 42″ and cage assembly 46″. Static plate member 90″ has a headed termination 97″. The rim of plate member 20″ is attached to the inner portion of headed termination 97″ which also acts as a guard against damage of rotatable platform member 30″.

Locking mechanism 70″ of alternate embodiment 10″ is similar to the one described above for the first alternate embodiment 10′ and labeled as locking mechanism 70′. Set screws 78″ and 79″ are used to deflect free ends 76″ and 77″ to engage posts 71″.

To use the present invention, a user stands on either platform member 30 (or the primed equivalents) or on static member 90′ in the first alternate embodiment. The user may propel himself with one foot placed against a supporting surface, e.g., floor, while standing on device 10 (or primed alternate embodiments) with the other foot. The resulting movements may or may not move the location of device 10. The user may also use his hands or by using accessories, such as bridle members (not shown), that provide additional points of support.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense, except as set forth in the following appended claims.

What is claimed is:

1. A recreational device to be used on a bearing surface comprising a circular contact plate member having a convex lower surface shaped to the periphery of the contact member as a portion of a sphere such that the lower surface of the plate member at all times forms a single point of contact with a bearing surface on which the contact plate member rests, a platform member supportably mounted on the upper surface of the contact plate member for rotation about the central axis of the circular plate member, said platform member having an outer circular periphery of a diameter substantially the same as that of the circular contact plate member, and the upper surface of the recreational device being substantially smooth and upwardly unobstructed from the center of the device throughout the full radial extent of the platform member for placement and support of the feet of a user thereon throughout its full radial extent.

2. A recreational device as defined in claim 1 further including adjustable locking means associated with the contact plate member and platform member for preventing relative rotation of the platform member and the contact plate member in selected directions about said circular plate member axis.

3. A recreational device as defined in claim 1 including locking means for selectively locking the platform member and plate member against relative rotation in one direction only, while permitting relative rotation of the platform member and the contact plate member in the opposite direction thereto.

4. A recreational device as defined in claim 1 wherein said contact plate member includes a plurality of protrusions perpendicularly mounted on the upper surface of the contact plate member, locking means including a first latch member attached to the lower surface of the platform member and having a free end portion, and first adjustment means operatively connecting the free end portion of said first latch member and the platform member for adjustable deflection of the free end portion of the latch member into and out of engagement with said contact plate member protrusions to prevent relative rotation of the platform member and contact plate member in a first direction only.

5. A recreational device as defined in claim 4 wherein said locking means includes a second latch member attached to the lower surface of the platform member and having a free end portion, and second adjustment means operatively connecting the platform member and the free end portion of the second latch member for adjustable deflection of the free end portion of the second latch member into and out of engagement with said contact plate member protrusions to prevent relative rotation of the platform member and the contact plate member only in a direction opposite to said first direction of rotation.

6. A recreational device as defined in claim 5 wherein said protrustions are radially extending rib members of said contact plate member.

7. A recreational device as defined in claim 5 wherein said first and second adjustment means comprise screw means having respective end portions exposed to the upper surface of said platform member for manual adjustment of said respective first and second latch member.

8. A recreational device as defined in claim 1 wherein the center of the lower surface of said platform member and the center of the upper surface of said contact plate member include cooperating hub and socket means for rotatable support of the platform member, and ball-bearing assembly means operatively associated with said lower surface of said platform member and upper surface of said contact plate member and disposed radially outwardly of said hub and socket means to facilitate support and rotational movement of the platform member relative to said contact plate member.

9. A recreational device as defined in claim 1 including openings in the upper surface of said platform member for receipt of handle or bridle means to facilitate handling and use of the device by a user.

* * * * *